United States Patent [19]

Stöckel et al.

[11] Patent Number: 4,574,014

[45] Date of Patent: Mar. 4, 1986

[54] PROCESS FOR MANUFACTURING A FORMED CONTACT PART

[75] Inventors: Dieter Stöckel, Birkenfeld; Friedrich E. Schneider, Pforzheim, both of Fed. Rep. of Germany

[73] Assignee: G. Rau GmbH & Co., Pforzheim, Fed. Rep. of Germany

[21] Appl. No.: 656,631

[22] Filed: Oct. 1, 1984

[30] Foreign Application Priority Data

Sep. 29, 1983 [DE] Fed. Rep. of Germany ..... 3335274

[51] Int. Cl.[4] ..... C21D 8/12

[52] U.S. Cl. ..... 148/11.5 P; 148/11.5 Q; 148/127; 428/929; 428/671; 428/673; 10/27 H; 200/266

[58] Field of Search ..... 148/11.5 R, 11.5 P, 148/11.5 Q, 431, 127; 428/929, 671, 673; 200/266, 265; 470/505, 501, 463, 590; 337/276 T, 278 C; 10/27 H

[56] References Cited

U.S. PATENT DOCUMENTS

| | | | |
|---|---|---|---|
| 2,241,262 | 5/1941 | Keitel | 470/505 |
| 2,652,624 | 9/1953 | Guinee | 428/929 |
| 2,932,595 | 4/1960 | Pflumm | 148/430 |
| 3,113,376 | 12/1963 | Pflumm et al. | 470/590 |
| 3,140,172 | 7/1964 | Coad | 470/590 |
| 3,205,099 | 9/1965 | Vordahl | 148/11.5 P |
| 3,676,916 | 7/1972 | Schierding et al. | 29/419 |
| 3,785,810 | 1/1974 | Durrwachter et al. | 148/431 |
| 3,807,994 | 4/1974 | Jost | 148/431 |
| 4,411,712 | 10/1983 | Marancik | 148/11.5 Q |

FOREIGN PATENT DOCUMENTS 2040463 8/1970 Fed. Rep. of Germany .

*Primary Examiner*—Christopher W. Brody

*Attorney, Agent, or Firm*—Sprung Horn Kramer & Woods

[57] ABSTRACT

In the manufacture of a formed contact part of a metal alloy, wherein the formed part is shaped in one or more manufacturing operations without the removal of metal to produce a contact element, the improvement which comprises forming from the alloying constituents a composite material in which the alloying constituents are heterogeneously embedded, the composite material being formed into the contact part without the removal of metal and, after forming, heating the contact part so as to convert the composite material into a homogeneous alloy. The process is particularly applicable to silver-palladium alloys where the alloy would not itself be suitable for the forming operation.

6 Claims, No Drawings

PROCESS FOR MANUFACTURING A FORMED CONTACT PART

The invention relates to a process for manufacturing a formed contact part from a metal alloy, and especially a noble metal alloy, in which the formed part is shaped in one or more manufacturing operations without the removal of metal to produce a contact element, e.g. a contact rivet. The process results simultaneously in the creation of a new type of formed contact part.

In various contact elements the use of a homogeneous noble metal alloy offers advantages over a composite material whose metal constituents are present in heterogeneous form.

For example, the strong affinity of silver for sulphur and substances containing sulphur greatly restricts its use as a contact material in low-current systems. Especially in humid conditions and heat, sulphur has the effect of forming extraneous layers of silver sulphide on the surface of contacts. These raise the contact resistance and can lead to contact failure if the mechanical forces or friction at the point of contact are insufficient to puncture or abrade the extraneous layers with their poor conductivity. Silver alloys containing other noble metals are generally more resistant to the effects of sulphurous atmospheres. An AgPd alloy containing 30% by weight of palladium is already largely resistant to the effects of sulphur, and still greater resistance to the formation of silver sulphide is exhibited by alloys with a higher palladium content of 40–50% wt.

As the palladium content of silver palladium alloys increases, so their hardness, mechanical strength and electrical resistance also rise, reaching a maximum when the silver and palladium are present in equal proportions by weight. One of the consequences of this is that alloys with a high percentage of palladium do not lend themselves readily to chipless forming.

Because of the considerable work-hardening experienced by these alloys when they are formed to produce contact elements, e.g. contact rivets, and because, also, of their high electrical resistance, such alloys stable in a sulphurous atmosphere cannot be used in the form of wire-shaped starting material to produce without waste by hot rivet welding what are known as bimetallic rivets, e.g. with a copper shank. Recourse has to be had to producing initially a clad AgPd/Cu plate from which small discs are punched for subsequent extrusion to form rivets. Because of the residue left behind after the plate has been punched, the process is very wasteful of material.

Composite materials, in which the metal constituents are present as fibres, powder particles or in other form, are generally easier to work and they are, in particular, more readily formed in a multi-stage process than alloys of the same composition. Against this, alloys often exhibit a greater resistance to environmental influences, and to sulphurous atmospheres especially, besides possessing other valuable properties.

The object of the invention is to provide a method of manufacturing a formed contact part in which the good forming properties of composite materials can be exploited without having to forego the attractive properties of homogeneous alloys in service.

This object is achieved by producing from the alloying constituents a composite material in which the alloying constituents are embedded in heterogeneous form, by forming the composite material without the removal of metal, and, after forming, by subjecting the composite material to heat treatment to convert it into a homogeneous alloy of the corresponding composition. This method of manufacture combines favorable forming conditions, possibly until the part acquires its final shape, with the subsequent creation of an alloy capable of possessing attractive functional properties.

The composite material can be produced by various familiar processes. The pressing of powder mixtures, the production of fiber composite materials and the extrusion of coils made up of strips of the constituents appear to be suitable techniques. In principle, the composite material can be produced by any method which does not cause extensive mixed crystal formation between the constituents.

The conversion of the heterogeneous composite material into the homogeneous alloy can be brought about by various heat treatments, where appropriate in several stages and possibly restricted to only part of the material. Conversion into the alloy may be suitably effected by the diffusion which occurs when the solid phase is heated. The speed of the conversion is the greater the more finely the constituents of the composite material are divided.

The final contact element normally reveals clearly that it is composed of an alloy which has been produced by the conversion of a heterogeneous composite material. This fact is indicated by characteristic variations in concentration.

For the manufacture of bimetallic rivets it appears to be expedient to butt weld wire-shaped lengths of the composite material to wire-shaped lengths of a supporting material which forms the shank of the rivet. The welded lengths of wire are then formed into the bimetallic rivet, and the formed rivets are subjected to a heat treatment to convert the composite material into the alloy.

EXAMPLE OF APPLICATION

As the initial stage in the manufacture of contact rivets a bundle of 500 covered wires with a silver coating and a palladium core (outside diameter 1.2 mm and core diameter 0.8 mm) is subjected to repeated wire drawing to produce a fiber composite material with an outside diameter of 3 mm. This fiber composite material comprises 500 palladium fibers embedded in a silver matrix. The proportion of palladium in the composite material amounts to 48% by weight.

In an automatic feeding and welding machine of conventional type the wire-shaped fiber composite material is cut into lengths of approximately 2 mm which are butt welded to 5 mm long sections of copper wire of the same diameter to act as support. The operation may suitably be performed by hot rivet welding using electrical resistance heating. The welded lengths of wire are then formed into bimetallic rivets, the heads and shanks being formed in the process. The formed bimetallic rivets are thereafter subjected to heat treatment at 750° C. for one hour, during which time diffusion converts the composite material into the alloy.

In its application, the process covered by the invention is not exclusively confined to noble metal alloys. By exploiting the favorable forming properties of the composite materials and the superior functional characteristics of the alloy, similar advantages can also be achieved in suitable cases with base metals, e.g. copper alloys. In addition the process can be employed to advantage in all cases where the final product is a formed part made of an alloy (two or more alloying constituents) and where the manufacturing process can be more effectively carried out by forming or otherwise working a composite material of the same composition.

It will be understood that the specification and examples are illustrative but not limitative of the present invention and that other embodiments within the spirit and scope of the invention will suggest themselves to those skilled in the art.

What is claimed:

1. In the manufacture of a formed bimetallic rivet having a contact part with constituents which include at least one noble metal, said constituents forming a metal alloy, wherein the contact part is shaped and butt welded to a wire-shaped length of a carrier material, the improvement which comprises forming from the alloy constituents a wire-shaped composite material in which the alloy constituents are heterogeneously embedded, cutting the composite material and the carrier material into lengths, butt-welding of the lengths of the composite and the carrier material, forming a bimetallic rivet from said butt welded lengths, subjecting said bimetallic rivet to heat treatment so as to convert the composite material into the alloy.

2. A process according to claim 1, wherein the composite material comprises silver.

3. A process according to claim 1, wherein the composite material comprises silver and palladium.

4. A process according to claim 1, wherein the composite material is produced by pressing a powder mixture.

5. A process according to claim 1, wherein the composite material is produced as a composite fiber material.

6. A process according to claim 1, wherein the composite material is produced in the form of an extruded coil made up of strips of the constituents.

* * * * *